US006497585B2

(12) United States Patent
Torii

(10) Patent No.: US 6,497,585 B2
(45) Date of Patent: Dec. 24, 2002

(54) HALF-FITTING PREVENTION CONNECTOR

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/864,179

(22) Filed: May 25, 2001

(65) Prior Publication Data

US 2001/0049219 A1 Dec. 6, 2001

(30) Foreign Application Priority Data

May 31, 2000 (JP) ..... 2000-162965

(51) Int. Cl.[7] ..... H01R 13/627
(52) U.S. Cl. ..... 439/352
(58) Field of Search ..... 439/352, 488, 439/489, 353, 350

(56) References Cited

U.S. PATENT DOCUMENTS 5,749,747 A 5/1998 Inaba et al. ..... 439/358
5,938,466 A 8/1999 Suzuki et al. ..... 439/352
6,106,321 A * 8/2000 Yoshida et al. ..... 439/352
6,254,424 B1 * 7/2001 Murakami et al. ..... 439/489
6,280,225 B1 * 8/2001 Nishide et al. ..... 439/352

FOREIGN PATENT DOCUMENTS

JP 9-55261 2/1997 ..... H01R/13/64
JP 9-180820 7/1997 ..... H01R/13/64

* cited by examiner

*Primary Examiner*—Gary Paumen
*Assistant Examiner*—Felix D. Figuerda
(74) *Attorney, Agent, or Firm*—Sughrue Mion, PLLC

(57) ABSTRACT

In a half-fitting prevention connector (1), a compression spring (20) is employed as a resilient member for preventing half-fitting between a male connector (2) and a female connector (3). The compression spring (20) is attachable to a housing (26) of the female connector (3) and includes a first bent portion (21)(formed into a substantially U-shape by bending a strip-shaped plate, a second bent portion (23) continuing from the first bent portion (21) and formed into a substantially V-shape by bending the strip-shaped plate, a fixing hole (24) located at a rear portion of the compression spring (20) and retained by a fixing projection (32), and a fixing rolled portion (25) located at the rear portion of the compression spring (20) and retained by pressing pieces (33).

3 Claims, 9 Drawing Sheets

1
2
3
4
5
6
7
8
9
10
20
21
22
23
24
25
26
27
28
29
30
31
32
33

HALF-FITTING PREVENTION CONNECTOR

BACKGROUND OF THE INVENTION

1. Field of the Invention

The present invention relates to a half-fitting prevention connector which reliably prevents half-fitting by way of the resiliency of a resilient member attached to a housing of at least one of a pair of male and female connectors which are fittable to each other, and which reliably effects fitting and locking with the mating connector.

The present application is based on Japanese Patent Application No. 2000-162965, which is incorporated herein by reference.

2. Description of the Related Art

A related example of a half-fitting prevention connector now will be described with reference to FIGS. 6 to 9.

As shown in FIGS. 6 to 7, in a half-fitting prevention connector 51, half-fitting between a pair of male and female connectors 52 and 53 which are fittable to each other is prevented by the resiliency of a pair of compression coil springs 57 accommodated in spring accommodating portions 56 on both sides in an exclusive housing 55 provided integrally on a housing 54 of the male connector 52.

In addition, the male connector 52 has a lock arm 58 which has on a lower surface of its tip a retaining pawl 59 for retaining the mating female connector 53 and is supported at its rear end on the housing 54 so as to be flexible as a cantilever. Further, displacement preventing projections 60 are provided on an upper surface of the lock arm 58 on the opposite side to the side where the retaining pawl 59 is provided, and a lock peak 61 is provided on the upper surface of its root portion.

In addition, a slider 62 is slidably held in the exclusive housing 55. The slider 62 has a slider body 66 on which a slider arm 69 which is upwardly flexible by using a rear portion of the slider body 66 as a root is formed. A pair of abutment projections 70 are provided on the lower surface of a front end of the slider arm 69. Further, a pressing portion 72 which can be pressed in the rearward direction by an operator's finger is provided on the upper surface of a rear end portion of the slider body 66.

Further, provided on an upper surface of a female housing 75 are an inclined projection 77 for retaining the retaining pawl 59 and a retaining groove 79 located immediately behind it, and a pair of stopper projections 78, which abut against the abutment projections 70 of the slider 62, are provided on the upper surface of the female housing 75.

In the half-fitting prevention connector 51 having the above-described construction, the male and female connectors 52 and 53 are made to face each other and are pressed in the fitting directions, as shown in FIG. 7. Then, since the stopper projections 78 on the female housing 75 abut against the abutment projections 70 of the slider 62, and the slider 62 is pushed in toward the rear of the exclusive housing 55 in the upper portion of the housing 54 while compressing the compression springs 57.

As a result, as the retaining pawl 59 rides over the inclined projection 77, the lock arm 58 is flexed upward, while the slider arm 69 is flexed upward by riding over the lock peak 61.

If the fitting forces of the male and female connectors 52 and 53 are canceled at this stage, the slider 62 is pushed back by the urging forces of the compression springs 57, so that the female connector 53 is pushed back by the abutment projections 70 and the stopper projections 78. Hence, the male and female connectors 52 and 53 are prevented from being left in a half-fitted state.

If the fitting operation is further advanced, as shown in FIG. 8, the slider arm 69 is flexed further upward by the lock peak 61 and the abutment projections 70 are disengaged from the stopper projections 78, with the result that the slider 62 is pushed back forwardly by the urging forces of the compression springs 57, and the front end of the pressing portion 72 abuts against the lock peak 61 and stops.

At this time, since the retaining pawl 59 is retained by the inclined projection 77 and the retaining groove 79, the flexion of the lock arm 58 also returns to its original state, and the displacement preventing portion 71 of the slider 62 which returned to its original state comes to be fitted over the displacement preventing projections 60 of the lock arm 58.

Next, to cancel the fitting between the male and female connectors 52 and 53, as shown in FIG. 9, the operator pulls the pressing portion 72 in the rearward direction while compressing the compression springs 57 while holding the housing 75. Consequently, the slider 62 retracts to allow the displacement preventing projections 60 to be canceled from the state of being locked by the displacement preventing portion 71, and since the abutment projections 70 ride over the stopper projections 78, the slider 69 begins to be flexed upward.

If the pressing portion 72 is further pulled, at the same time as the tip portion of the slider arm 69 rides over the lock peak 61, the retaining pawl 59 becomes unlocked from the inclined projection 77 since its rear surface is inclined, so that the fitting between the male and female connectors 52 and 53 can be canceled.

However, with the above-described half-fitting prevention connector 51, there has been a possibility that since the slider 62 is required, the number of component parts increases, and the number of assembling steps increases, leading to higher cost.

In addition, since when the pressing portion 72 is pulled backward during the releasing operation for the connectors, the pressing portion 72 must be pulled while compressing the compression springs, there has been a possibility that the operating efficiency during the releasing operation for the connectors is poor.

Furthermore; since resin members such as the lock arm 58 and the slider arm 69 are flexed greatly during the fitting and releasing operation of the connectors 52 and 53, there has been a possibility in the durability.

SUMMARY OF THE INVENTION

The present invention has been devised in view of the above-described possibilities of the related art, and its object is to provide a half-fitting prevention connector which has a small number of component parts, offers satisfactory operating efficiency during the releasing operation for the connectors, and excels in the durability with small flexion of resin members during the fitting and releasing operation.

To achieve the above object, according to a first aspect of the present invention, there is provided a half-fitting prevention connector which comprises:

- a first connector including a first housing;
- a flexible lock arm formed on the first housing, the flexible lock arm having a first retaining portion and an abutment portion which is located at a lower side relative to the first retaining portion;
- a second connector fittable to the first connector, the second connector including a second housing having a second retaining portion and a press plate;

a resilient member attachable to the second housing, the resilient member including:

a first bent portion which is formed into a substantially U-shape by bending a strip-shaped plate, and a second bent portion, which continues from the first bent portion, and is formed into a substantially V-shape by bending the strip-shaped plate; and a fixing mechanism, with which a rear portion of the resilient member is fixedly secured to the second housing, wherein when the first connector and the second connector are about to be fitted to each other, the flexible lock arm is flexed by the press plate of the second housing pressing downward the first retaining portion, and the first retaining portion is slid on the press plate so that the abutment portion of the flexible lock arm is abutted against a tip of the first bent portion of the resilient member, wherein when the first connector and the second connector are incompletely fitted, the first connector and the second connector are released in a direction opposite to a connector fitting direction in accordance with a resilient force of the resilient member, and wherein when the first connector and the second connector are completely fitted to each other, the first retaining portion of the flexible lock arm is a retained by the second retaining portion of the second housing.

In accordance with the first aspect of the present invention, since a slider is not required, the number of component parts can be reduced, the structure is simplified, and the number of assembling steps can be reduced, thereby making it possible to lower the cost.

Furthermore, since the amount of the flexion of the lock arm during the fitting and releasing operation of the male and female connectors is small, and resin members other than the lock arm are not flexed, it is possible to improve the durability of the connector.

For example, when a compression spring is employed as the resilient member, since the compression spring is so arranged as not to be compressed during the unlocking operation, it is unnecessary to pull back the operating portion against the urging force of the compression spring during the releasing operation, so that it is possible to improve the operating efficiency during the releasing operation.

Furthermore, to achieve the above object, according to a second aspect of the present invention, there is provided a half-fitting prevention connector which comprises:

a first connector including a first housing;

a flexible lock arm formed on the first housing, the flexible lock arm having a first retaining portion and an abutment portion which is located at a lower side relative to the first retaining portion;

a second connector fittable to the first connector, the second connector including a second housing having a second retaining portion, a press plate, and a second fixing portion; and a resilient member attachable to the second housing, the resilient member including:

a first bent portion which is formed into a substantially U-shape by bending a strip-shaped plate, a second bent portion, which continues from the first bent portion, and is formed into a substantially-shape by bending the strip-shaped plate, and a first fixing portion, which is located at a rear portion of the resilient member, and is retained by the second fixing portion of the second housing, wherein when the first connector and the second connector are about to be fitted to each other, the flexible lock arm is flexed by the press plate of the second housing pressing downward the first retaining portion, and the first retaining portion is slid on the press plated so that the abutment portion of the flexible lock arm is abutted against a tip of the first bent portion of the resilient member, wherein when the first connector and the second connector are incompletely fitted, the first connector and the second connector are released in a direction opposite to a connector fitting direction in accordance with a resilient force of the resilient member, and wherein when the first connector and the second connector are completely fitted to each other, the first retaining portion of the flexible lock arm is retained by the second retaining portion of the second housing.

In accordance with the second aspect of the present invention, since the resilient member is surely fixedly secured to the housing by the fixing portions as described above, the reliability of attachment of the resilient member can be improved. Therefore, it is possible to improve productivity.

Furthermore, to achieve the above object, according to a third aspect of the present invention, there is provided a half-fitting prevention connector which comprises:

a first connector including a first housing;

a flexible lock arm formed on the first housing, the flexible lock arm having a first retaining portion and an abutment portion which is located at a lower side relative to the first retaining portion;

a second connector fittable to the first connector, the second connector including a second housing having a second retaining. portion, a press plate, a fixing projection formed uprightly on the second housing, and a pressing piece formed uprightly on the second housing; and a resilient member attachable to the second housing, the resilient member including:

a first bent portion which is formed into a substantially U-shape by bending a strip-shaped plate, a second bent portion, which continues from the first bent portion, and is formed into a substantially V-shape by bending the strip-shaped plate, a fixing hole, which is located at a rear portion of the resilient member, and is retained by the fixing projection of the second housing, and a, fixing rolled portion, which is formed into a substantially roll shape by rolling the strip-shaped plate, and is located at the rear portion of the resilient member, the fixing rolled portion being retained by the pressing piece of the second housing, wherein when the first connector and the second connector are about to be fitted to each other, the flexible lock arm is flexed by the press plate of the second housing pressing downward the first retaining portion, and the first retaining portion is slid on the press plate so that the abutment portion of the flexible lock arm is abutted against a tip of the first bent portion of the resilient member, wherein when the first connector and the second connector are incompletely fitted, the first connector and the second connector are released in a direction opposite to a connector fitting direction in accordance with a resilient force of the resilient member, and wherein when the first connector and the second connector are completely fitted to each other, the first retaining portion of the flexible lock arm is retained by the second retaining portion of the second housing.

In accordance with the third aspect of the present invention, the assembling operation at the time of attaching the resilient member to the housing can be facilitated. Further, since the resilient member is formed of a strip, the fixing hole and the fixing rolled portion can be provided integrally. Therefore, it is possible to improve productivity and attain a reduction in the cost.

BRIEF DESCRIPTION OF THE DRAWINGS

The above and other objects and advantages of the present invention will become more apparent by describing in detail a preferred embodiment thereof with reference to the accompanying drawings, wherein.

DETAILED DESCRIPTION OF THE PREFERRED EMBODIMENT

Referring now to FIGS. 1 to 5, a detailed description will be given of an embodiment of a half-fitting prevention connector in accordance with the present invention.

Figure 1:
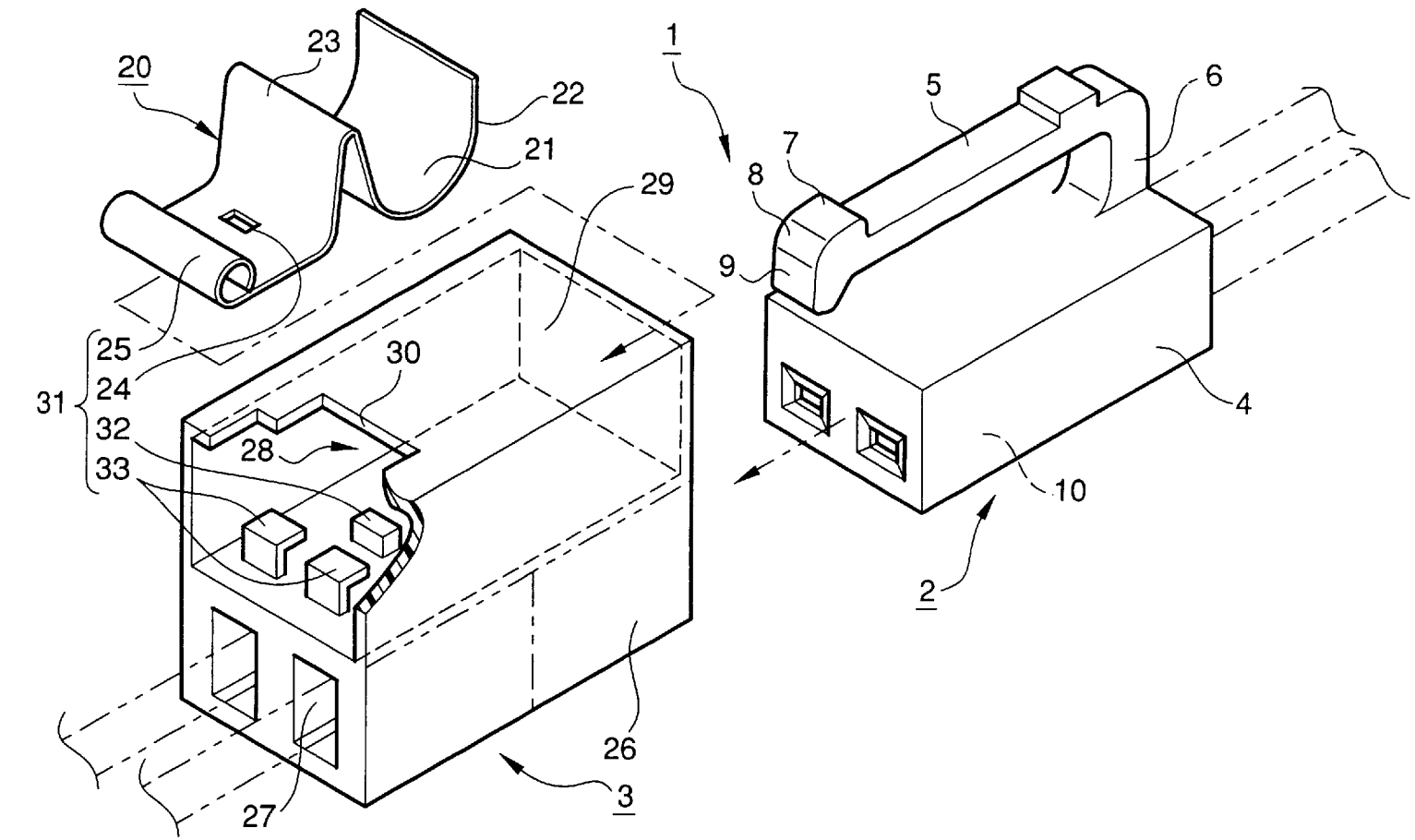
FIG. 1 is an exploded perspective view illustrating an embodiment of a half-fitting prevention connector in accordance with the present invention.
Figure 2:
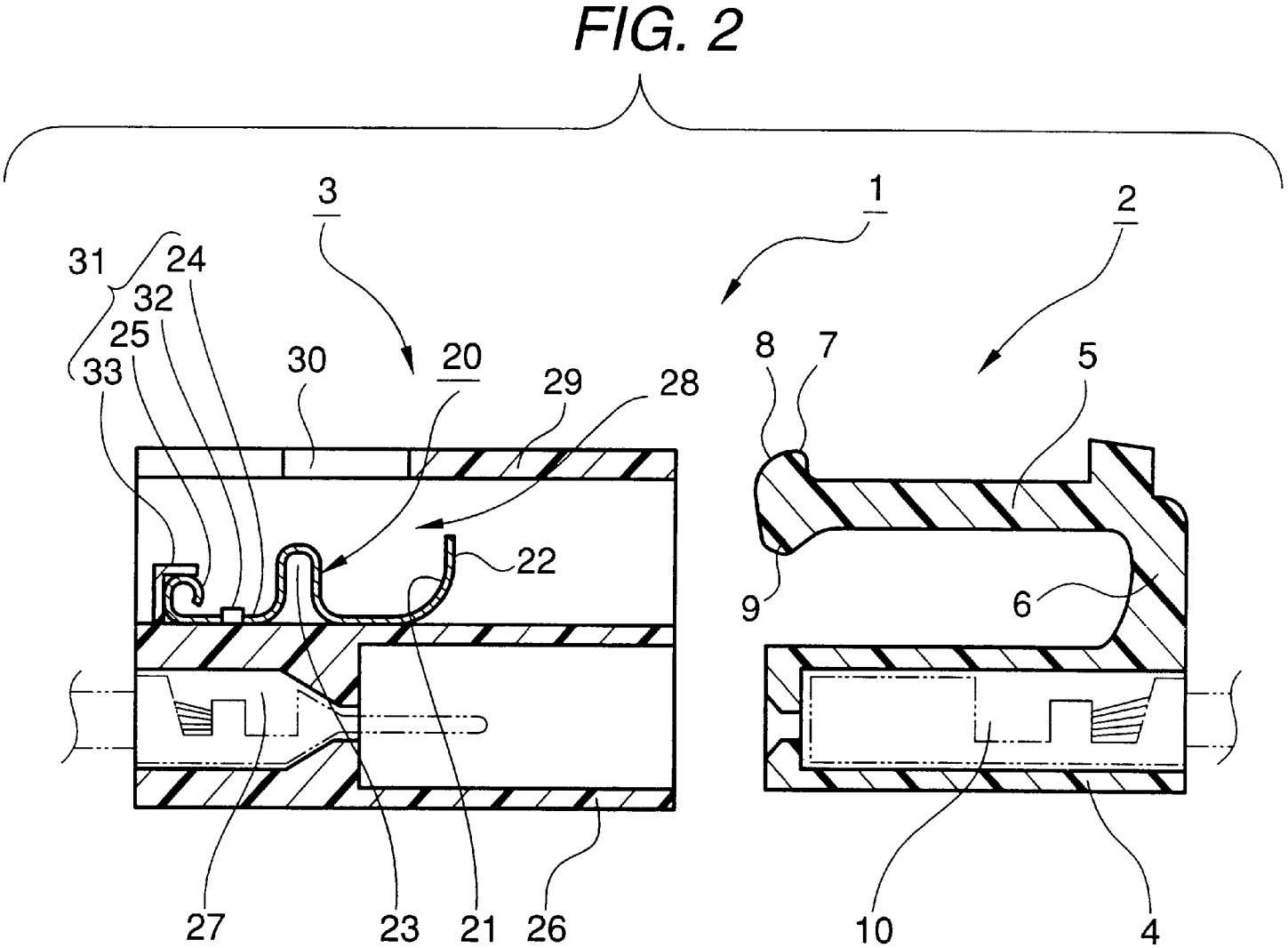
FIG. 2 is an operational diagram illustrating a state in which male and female connectors shown in FIG. 1 are starting to be fitted.

As shown in FIGS. 1 and 2, in a half-fitting prevention connector 1 in this embodiment, half-fitting between a pair of male and female connectors 2 and 3, which are fittable to each other, is prevented by resiliency of a compression spring 20 accommodated in a housing 26 of the female connector 3. Further, at the time of fitting with the male connector 2, a lock arm 5, which is supported at its proximal end by a column 6 on a housing 4 of the male connector 2 and has a retaining pawl 7 at its distal end, is flexed in cooperation with the compression spring 20 so as to be retained in a retaining recess 30 in the female connector 3.

It should be noted that a terminal accommodating chamber 10 for accommodating a pair of connecting terminals, e.g., a pair of female terminals having covered wires connected to their rear ends, is provided inside the housing 4 of the male connector 2. Meanwhile, a terminal accommodating chamber 27 for accommodating, for example, a pair of male terminals having covered wires connected to their rear ends, is provided in a rear half portion of the housing 26 of the female connector 3. The housing 26 is fitted in such a manner as to cover outer surfaces of the housing 4.

The compression spring 20 has a first bent portion 21 formed by bending a strip-shaped plate into a substantially U-shape with its upper side open, as well as an appropriate number (one in FIGS. 1 to 5) of second bent portions 23 continuing from the first bent portion 21 and bent in a substantially V-shape with its lower side open. Further, a fixing mechanism 31 which is fixed in an exclusive space 28 in an upper portion of the female housing 26 is provided in a rear portion of the compression spring 20. The top plate of the female housing 26 above the exclusive space 28 is formed as a press plate 29 for pressing the retaining pawl 7 downward and causing it to slide, and the retaining recess 30 for retaining the retaining pawl 7 is formed on the rear side of the press plate 29. Meanwhile, an abutment projection 9 for abutting against a tip 22 of the first bent portion 21 is provided on a lower portion of the retaining pawl 7.

It should be noted that an inclined surface 8 is provided at an upper surface of the front end of the retaining pawl 7, and is adapted to abut against and slide on the front end of the press plate 29 so as to deflect the lock arm 5 downward. Although the front end face of the abutment projection 9 is formed as a substantially vertical surface, an inclined surface oriented from its root toward the front is formed at the rear end face of the abutment projection 9.

in addition, the fixing mechanism 31 of the compression spring 20 includes a fixing hole 24 which is retained by a fixing projection 32 provided uprightly in the female housing 26, as well as a fixing rolled portion 25 which is retained by a pair of inverse-L shaped pressing pieces 33 provided uprightly in the female housing 26 and which is formed by rolling the strip.

In the half-fitting prevention connector 1 having the above-described construction, if the compression spring 20 is pushed into the exclusive space 28 in the upper portion of the housing 26 diagonally downward from the front side, the fixing rolled portion 25 while being pressed by the pressing pieces 33, and the fixing hole 24 is fitted over and fixed by the fixing projection 32. Consequently, the compression spring 20 is accommodated in the exclusive space 28.

Further, a pair of female terminals, to which covered wires are respectively connected, are inserted into the terminal accommodating chamber 10 from its rear side, and are positioned by retaining lances and the like. Meanwhile, a pair of male terminals, to which covered wires are respectively connected, are inserted into the terminal accommodating chamber 27 in the rear portion of the housing 26 from their rear sides, and are positioned by retaining lances and the like.

Next, referring to FIGS. 2 to 5, a description will be given of the fitting operation. First, as shown in FIG. 2, the male and female connectors 2 and 3 are made to face each other and are pressed toward each other in the fitting directions. Then, since the inclined surface 8 of the retaining pawl 7 abuts against the press plate 29, the lock arm 5 is flexed downward, and the retaining pawl 7 advances while sliding on the inner surface of the press plate 29.

Figure 3:
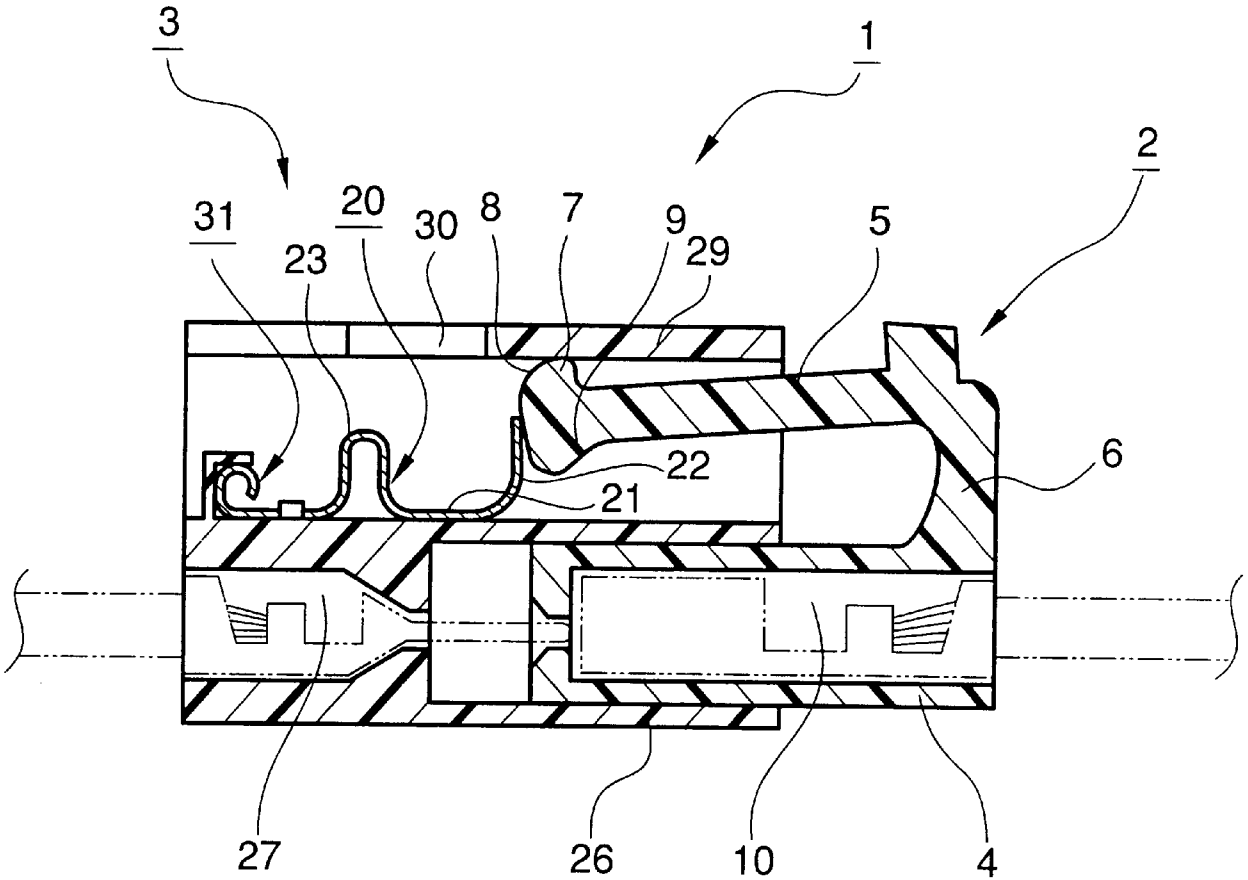
FIG. 3 is an operational diagram illustrating a state in which the male and female connectors shown in FIG. 1 are fitted halfway.

Then, as shown in FIG. 3, since the tip 22 of the compression spring 20 abuts against the abutment projection 9 located on the lower side of the retaining pawl 7, the first and second bent portions 21 and 23 are compressed, so that the urging force in the direction opposite to the fitting direction gradually increases. At this juncture, the male and female connectors 2 and 3 are pressed against each other in a state in which in so far as the lock arm 5 is downwardly flexed, the front end face of the abutment projection 9 is not dislocated from the tip 22 of the first bent portion 21 since it is formed as a substantially vertical surface.

Then, the retaining pawl 7 advances to a position persisting immediately before engagement with the retaining recess 30, as shown in FIG. 3. This state is a final end of a half-fitting motion, and when the fitting force is canceled in the meantime, the female connector 3 is pushed back by the urging force of the compression spring 20, thereby preventing the half-fitting.

Figure 4:
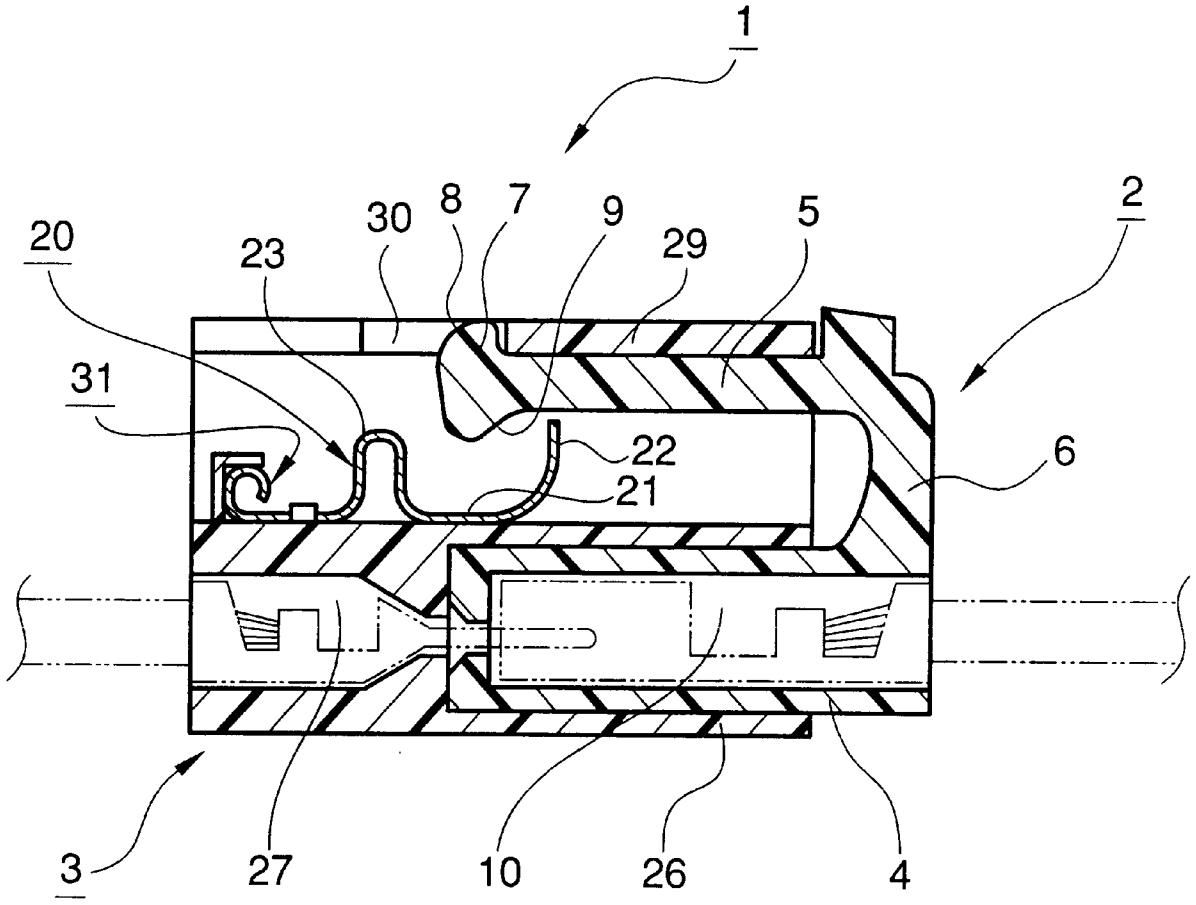
FIG. 4 is a cross-sectional view illustrating a state in which the male and female connectors shown in FIG. 1 are completely fitted.

Next, when the fitting operation is further advanced from the final end of the half-fitting motion, the retaining pawl 7 is engaged in the retaining recess 30, as shown in FIG. 4. Then, the flexion of the lock arm 5 is returned to its original state, thereby assuming a completely fitted state. Further, the abutment projection 9 on the lower side of the retaining pawl 7 is flexed upward, so that the abutment projection 9 is disengaged from the tip 22 of the compression spring 20, and the compression spring 20 is set in a free state.

Then, whether the state is the half-fitted state or the completely fitted state of the connectors can be determined by visually observing the state of engagement between the retaining pawl 7 and the retaining recess 30.

Figure 5:
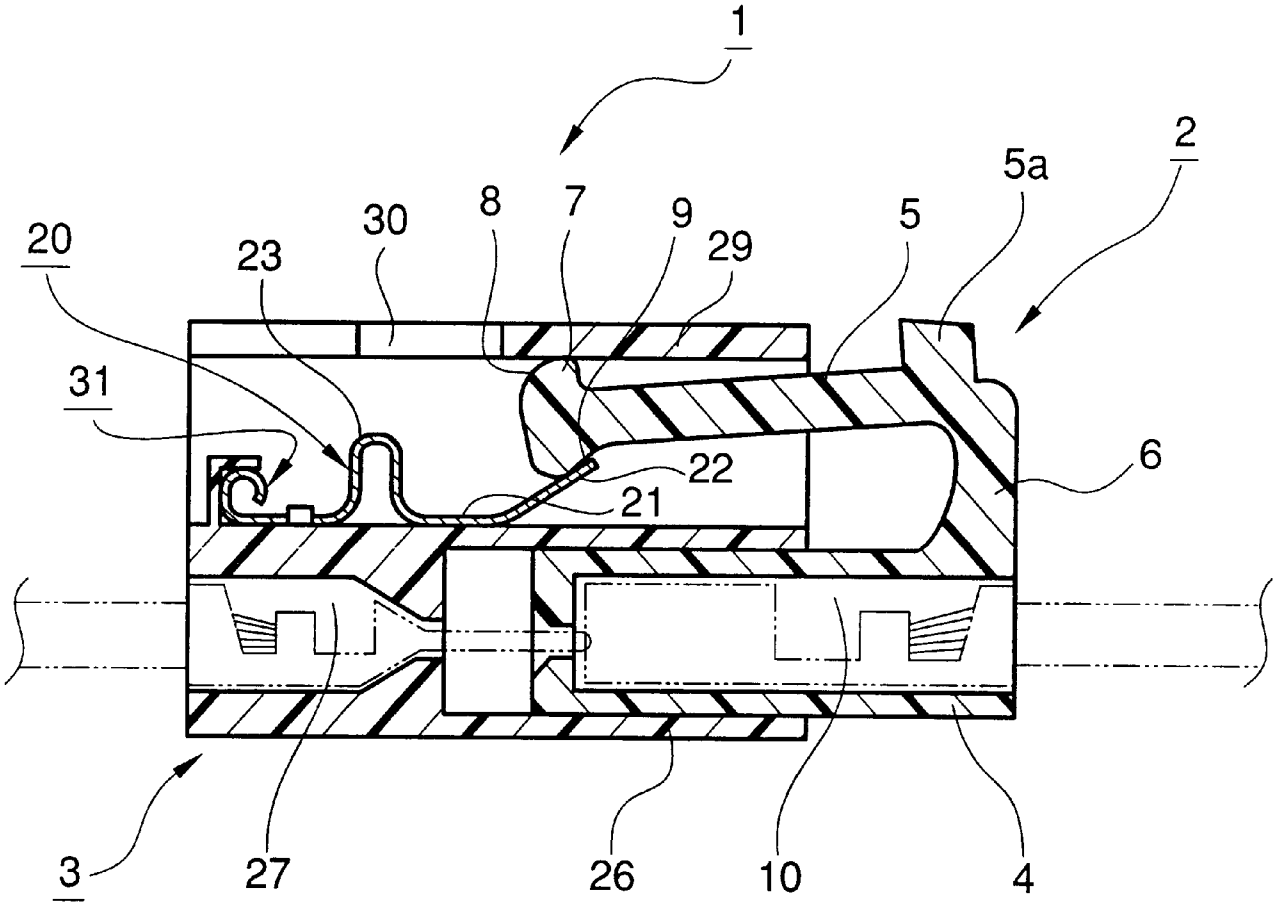
FIG. 5 is an operational diagram illustrating a state in which the male and female connectors shown in FIG. 4 are released.
Figure 6:
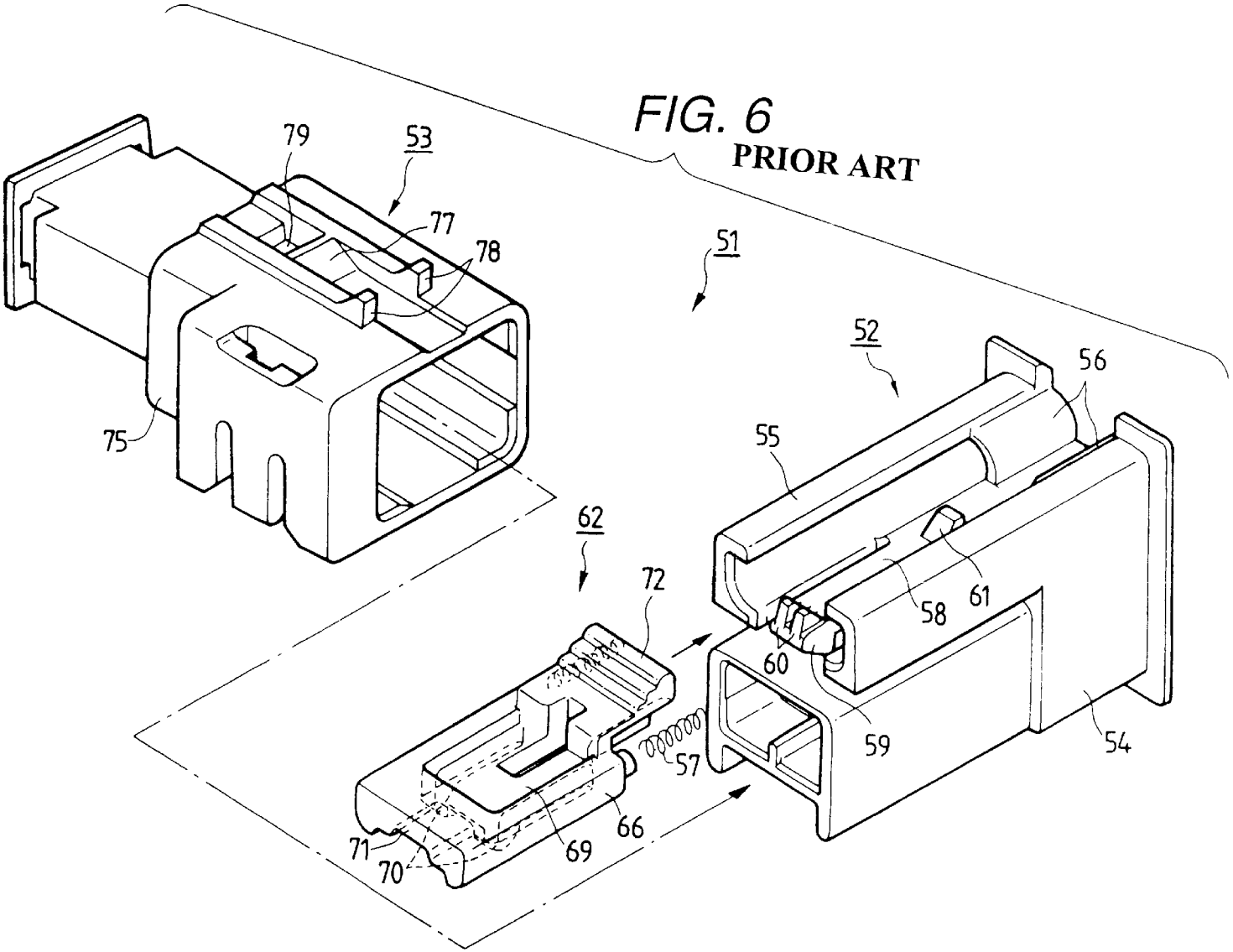
FIG. 6 PRIOR ART
FIG. 6 is an exploded perspective view illustrating a related example of a half-fitting prevention connector.
Figure 7:
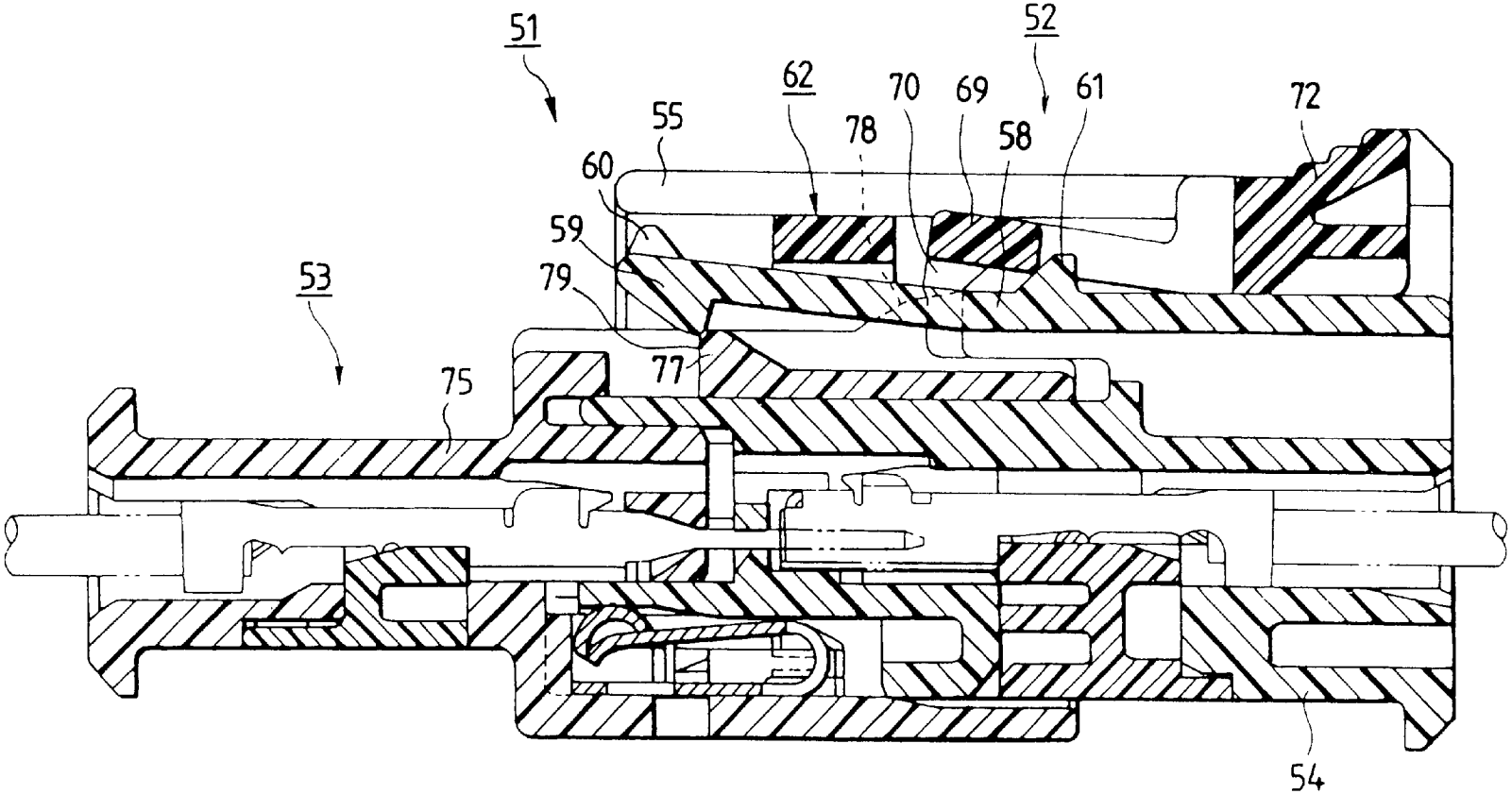
FIG. 7 PRIOR ART
FIG. 7 is an operational diagram illustrating a state in which male and female connectors shown in FIG. 6 are fitted halfway.
Figure 8:
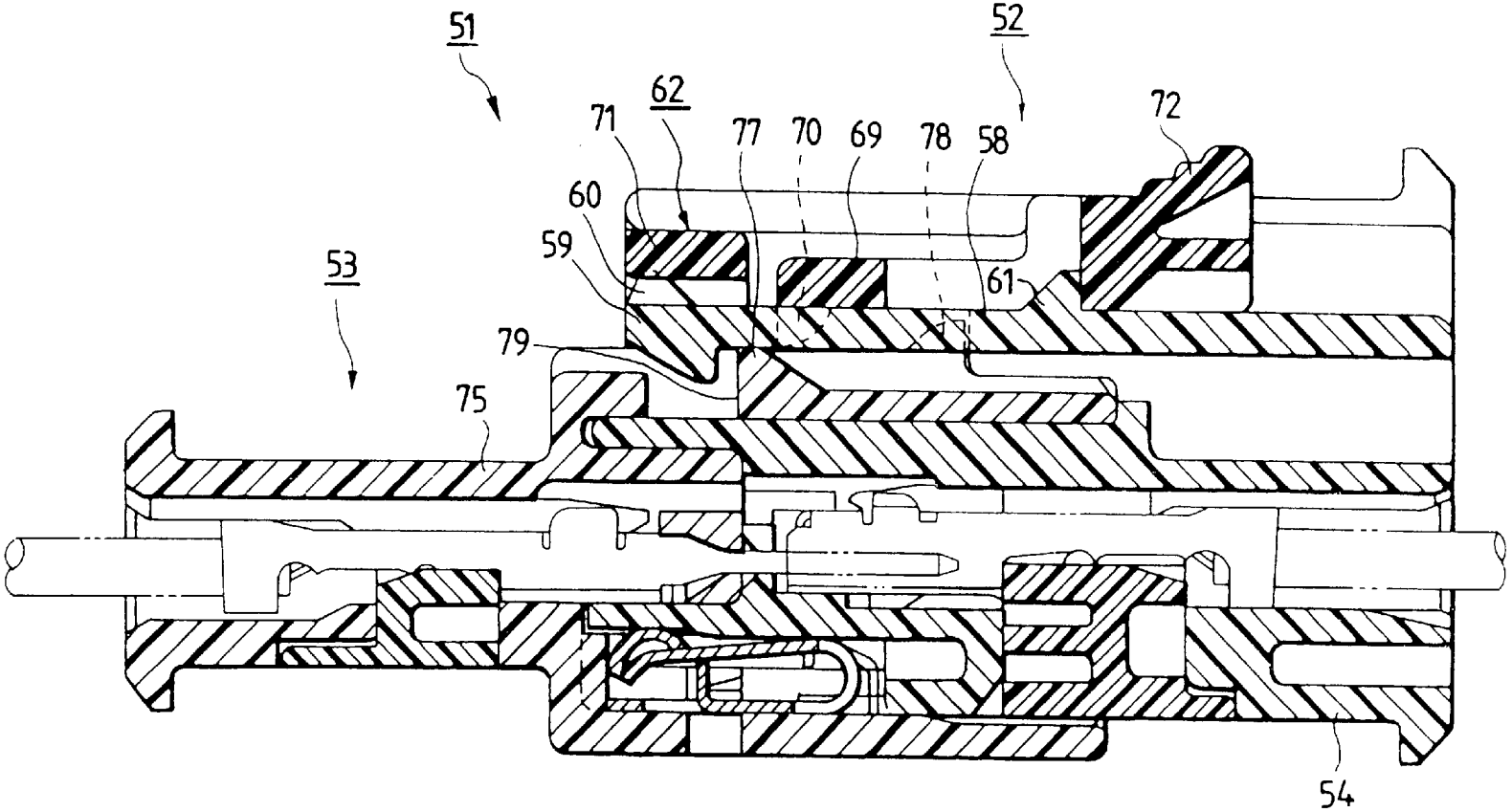
FIG. 8 PRIOR ART
FIG. 8 is an operational diagram illustrating a state in which the male and female connectors shown in FIG. 6 are completely fitted.
Figure 9:
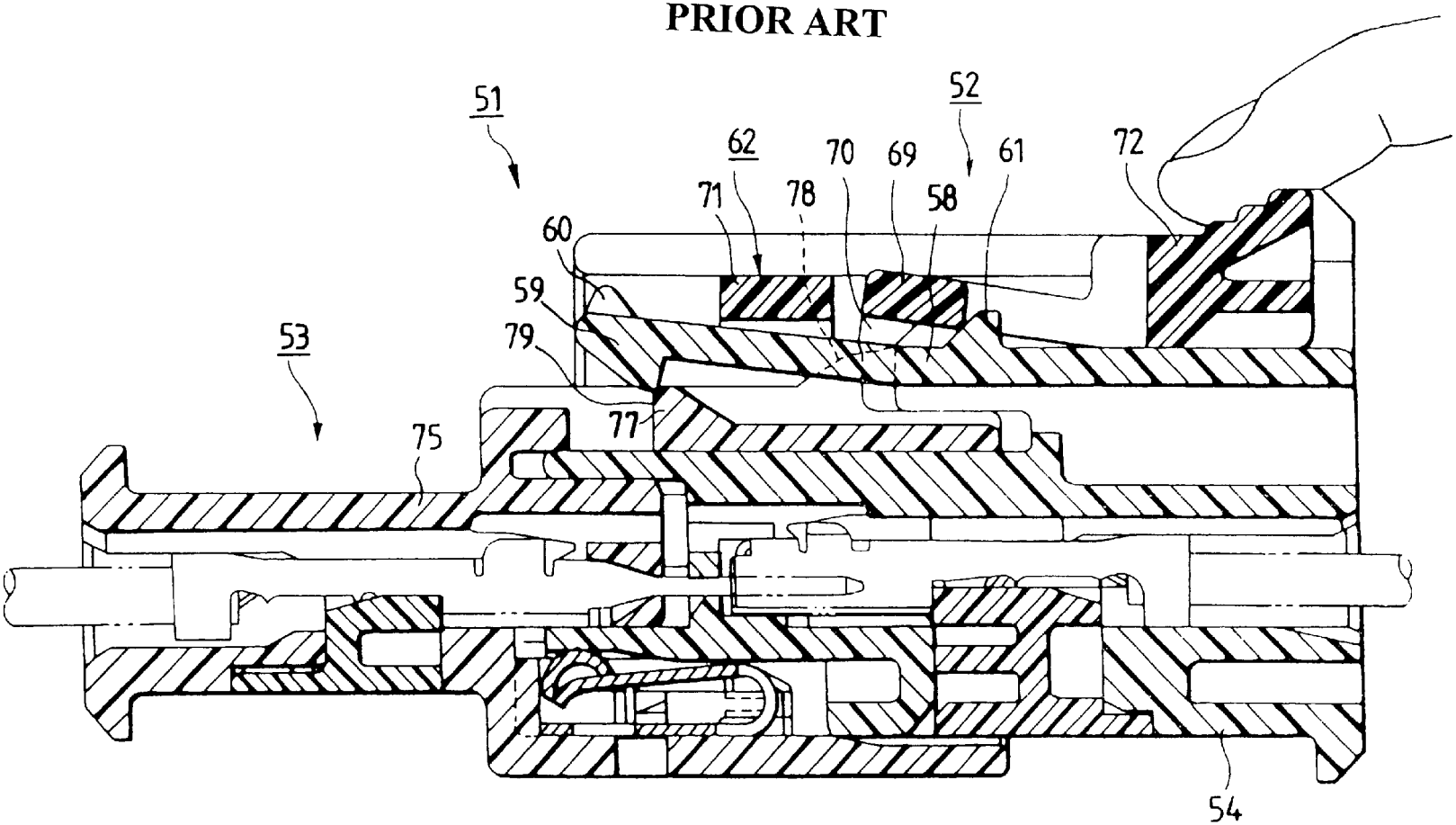
FIG. 9 PRIOR ART
FIG. 9 is an operational diagram illustrating a state in which the male and female connectors shown in FIG. 8 are released.

Next, to cancel the completely fitted state of the connectors, if the operator presses an operating portion 5*a* while holding the housings 4 and 26 of the male and female connectors 2 and 3, as shown in FIG. 5, so as to cancel the engagement between the retaining pawl 7 and the retaining recess 30, and the male and female connectors 2 and 3 are pulled away from each other, the engagement is easily canceled in a procedure opposite to that of the above-described fitting operation.

However, even if the lock arm 5 is flexed downward, since the abutment projection 9 is located within the first bent portion 21 as shown in FIG. 4, the abutment projection 9 does not abut against the tip 22, so that the compression spring 20 is in a substantially unloaded free state during the start of the releasing operation of the connectors. Accordingly, since the urging force is not applied, so that the force with which the male connector 2 is pulled away from the female connector 3 while deflecting the lock arm 5 can be small.

In addition, although the abutment projection 9 abuts against the rear side of the tip 22 in the final stage of the releasing operation as shown in FIG. 5, since the rear surface of the abutment projection 9 is inclined, the abutment projection 9 is able to easily ride over the tip 22 while deflecting the tip 22 despite the fact that the lock arm 5 is flexed downward.

In the half-fitting prevention connector 1 having the above-described construction in accordance with this embodiment, the compression spring 20 has the first bent portion 21 formed by bending a strip-shaped plate into a substantially U-shape with its upper side open, as well as an appropriate number of second bent portions 23 continuing from the first bent portion 21 and bent in a substantially V-shape with its lower side open. Further, the fixing mechanism 31 which is fixed in the exclusive space 28 in the upper portion of the female housing 26 is provided in a rear portion of the compression spring 20. The top plate of the female housing 26 above the exclusive space 28 is formed as the press plate 29 for pressing the retaining pawl 7 downward and causing it to slide, and the retaining recess 30 for retaining the retaining pawl 7 is formed on the rear side of the press plate 29. Meanwhile, the abutment projection 9 for abutting against the tip 22 of the first bent portion 21 is provided on a lower portion of the retaining pawl 7.

Accordingly, since a slider is not required, the number of component parts can be reduced, the structure is simplified, and the number of assembling steps can be reduced, thereby making it possible to lower the cost.

Furthermore, since the amount of the flexion of the lock arm 5 during fitting and releasing operation of the male and female connectors 2 and 3 is small, and resin members other than the lock arm 5 are not flexed, it is possible to improve the durability of the connector.

In addition, since practically no load is applied to the compression spring 20 during the unlocking operation, it is unnecessary to pull back the operating portion against the urging force of the compression spring 20 during the releasing operation of the connectors, so that the releasing operation of the connectors is facilitated. Accordingly, it is possible to improve the operating efficiency during the releasing operation.

In addition, the fixing mechanism 31 of the compression spring 20 includes the fixing hole 24 which is retained by the fixing projection 32 provided uprightly in the female housing 26, as well as the fixing rolled portion 25 which is retained by the pressing pieces 33 provided uprightly in the female housing 26 and which is formed by rolling the strip.

Therefore, the assembling operation at the time of fitting the compression spring 20 to the female housing 26 can be facilitated.

Further, since the compression spring 20 is formed of a strip, the fixing hole 24 and the fixing rolled portion 25 can be provided integrally. Therefore, it is possible to improve productivity and attain a reduction in the cost.

It should be noted that the present invention is not limited to the above-described embodiment, and may be implemented in other forms by making appropriate modifications. For example, although in the above-described embodiment only one second bent portion 23 is provided in the compression spring 20, by using two or more second bent portions 23 and by lowering the spring constant, it is possible to prevent the urging force from increasing sharply as the fitting progresses.

It is contemplated that numerous modifications may be made to the half-fitting prevention connector of the present invention without departing from the spirit and scope of the invention as defined in the following claims.

What is claimed is:

1. A half-fitting prevention connector, comprising:

a first connector including a first housing;

a flexible lock arm formed on the first housing, the flexible lock arm having a first retaining portion and an abutment portion which is located at a lower side of the flexible lock arm relative to the first retaining portion;

a second connector fittable to the first connector, the second connector including a second housing having a second retaining portion and a press plate;

a resilient member attachable to the second housing, the resilient member including:

a first bent portion which is formed into a substantially U-shape by bending a strip-shaped plate, and a second bent portion, which continues from the first bent portion, and is formed into a substantially V-shape by bending the strip-shaped plate; and a fixing mechanism, with which a rear portion of the resilient member is fixedly secured to the second housing, wherein when the first connector and the second connector are about to be fitted to each other, the flexible lock arm is flexed by the press plate of the second housing pressing downward the first retaining portion, and the first, retaining portion is slid on the press plate so that the abutment portion of the flexible lock arm is abutted against a tip of the first bent portion of the resilient member, wherein when the first connector and the second connector are incompletely fitted, the first connector and the second connector are released in a direction opposite to a connector fitting direction in accordance with a resilient force of the resilient member, wherein when the first connector and the second connector are completely fitted to each other, the first retaining portion of the flexible lock arm is retained by the second retaining portion of the second housing, and the abutment portion is disposed within the resilient member.

2. A half-fitting prevention connector, comprising:

a first connector including a first housing;

a flexible lock arm formed on the first housing, the flexible lock arm having a first retaining portion and an abutment portion which is located at a lower side of the flexible lock arm relative to the first retaining portion;

a second connector fittable to the first connector, the second connector including a second housing having a second retaining portion, a press plate, and a second fixing portion; and a resilient member attachable to the second housing, the resilient member including:

a first bent portion which is formed into a substantially U-shape by bending a strip-shaped plate, a second bent portion, which continues from the first bent portion, and is formed into a substantially V-shape by bending the strip-shaped plate, and a first fixing portion, which is located at a rear portion of the resilient member, and is retained by the second fixing portion of the second housing, wherein when the first connector and the second connector are about to be fitted to each other, the flexible lock arm is flexed by the press plate of the second housing pressing downward the first retaining portion, and the first retaining portion is slid on the press plate so that the abutment portion of the flexible lock arm is abutted against a tip of the first bent portion of the resilient member, wherein when the first connector and the second connector are incompletely fitted, the first connector and the second connector are released in a direction opposite to a connector fitting direction in accordance with a resilient force of the resilient member, wherein when the first connector and the second connector are completely fitted to each other, the first retaining portion of the flexible lock arm is retained by the second retaining portion of the second housing, and the abutment portion is disposed within the resilient member.

3. A half-fitting prevention connector, comprising:

a first connector including a first housing;

a flexible lock arm formed on the first housing, the flexible lock arm having a first retaining portion and an abutment portion which is located at a lower side of the flexible lock arm relative to the first retaining portion;

a second connector fittable to the first connector, the second connector including a second housing having a second retaining portion, a press plate, a fixing projection formed uprightly on the second housing, and a pressing piece formed uprightly on the second housing; and a resilient member attachable to the second housing, the resilient member including:

a first bent portion which is formed into a substantially U-shape by bending a strip-shaped plate, a second bent portion, which continues from the first bent portion, and is formed into a substantially V-shape by bending the strip-shaped plate, a fixing hole, which is located at a rear portion of the resilient member, and is retained by the fixing projection of the second housing, and a fixing rolled portion, which is formed into a substantially roll shape by rolling the strip-shaped plate, and is located at the rear portion of the resilient member, the fixing rolled portion being retained by the pressing piece of the second housing, wherein when the first connector and the second connector are about to be fitted to each other, the flexible lock arm is flexed by the press plate of the second housing pressing downward the first retaining portion, and the first retaining portion is slid on the press plate so that the abutment portion of the flexible lock arm is abutted against a tip of the first bent portion of the resilient member, wherein when the first connector and the second connector are incompletely fitted, the first connector and the second connector are released in a direction opposite to a connector fitting direction in accordance with a resilient force of the resilient member, and wherein when the first connector and the second connector are completely fitted to each other, the first retaining portion of the flexible lock arm is retained by the second retaining portion of the second housing.

* * * * *